US008316956B2

(12) United States Patent
Horstman et al.

(10) Patent No.: US 8,316,956 B2
(45) Date of Patent: Nov. 27, 2012

(54) WRENCHLESS ADJUSTABLE/COMPLIANT MOLDBOARD INSERT

(75) Inventors: Nathan Joseph Horstman, Durango, IA (US); Leroy Ernest Kraske, Dubuque, IA (US)

(73) Assignee: Deere & Company, Moline, IL (US)

( * ) Notice: Subject to any disclaimer, the term of this patent is extended or adjusted under 35 U.S.C. 154(b) by 1165 days.

(21) Appl. No.: 11/608,670

(22) Filed: Dec. 8, 2006

(65) Prior Publication Data

US 2008/0138154 A1 Jun. 12, 2008

(51) Int. Cl.
*E02F 3/00* (2006.01)

(52) U.S. Cl. ..... 172/781; 172/795

(58) Field of Classification Search ..... 172/781, 172/789, 795, 796, 815; 411/340, 409, 544, 411/402, 166; 70/146, 199, 200
See application file for complete search history.

(56) References Cited

U.S. PATENT DOCUMENTS

| | | | | | |
|---|---|---|---|---|---|
| 2,258,890 | A * | 10/1941 | Gustafson | 172/793 |
| 3,463,243 | A * | 8/1969 | Fisher | 172/781 |
| 3,465,829 | A * | 9/1969 | McCarthy et al. | 172/667 |
| 3,983,945 | A * | 10/1976 | Hart et al. | 172/795 |
| 4,037,670 | A * | 7/1977 | Atherton et al. | 172/795 |
| 4,074,767 | A * | 2/1978 | Cole | 172/781 |
| 4,084,643 | A * | 4/1978 | Easterling | 172/795 |
| 4,604,864 | A | 8/1986 | Lupoli | |
| 4,683,959 | A * | 8/1987 | Clemens | 172/795 |
| 5,076,370 | A | 12/1991 | Stubben et al. | |
| 5,687,800 | A | 11/1997 | Wilkening | |
| 5,711,054 | A * | 1/1998 | Salice | 16/382 |
| 5,720,353 | A | 2/1998 | Wilkening | |
| 6,234,127 | B1 * | 5/2001 | Simpson et al. | 123/90.31 |
| 6,585,059 | B2 | 7/2003 | Michael, Jr. et al. | |
| 6,609,575 | B1 * | 8/2003 | Crabb | 172/439 |
| 6,751,894 | B2 * | 6/2004 | Verseef | 37/266 |
| 6,799,640 | B2 | 10/2004 | McGugan | |
| 6,813,849 | B2 | 11/2004 | McGugan | |
| 7,048,071 | B1 * | 5/2006 | Huenink et al. | 172/439 |
| 2002/0170724 | A1 * | 11/2002 | McGugan | 172/781 |
| 2005/0254921 | A1 * | 11/2005 | Leblanc | 411/409 |
| 2006/0042131 | A1 | 3/2006 | Pinther, II et al. | |
| 2006/0070758 | A1 * | 4/2006 | Ryan et al. | 172/781 |
| 2006/0192357 | A1 * | 8/2006 | Lin | 280/87.042 |

* cited by examiner

*Primary Examiner* — Thomas B Will
*Assistant Examiner* — Matthew D Troutman
(74) *Attorney, Agent, or Firm* — Faegre Baker Daniels LLP

(57) ABSTRACT

A grader-blade retainer assembly affording side-to-side movement of the blade that provides a compliant attachment of an upper retainer assembly to the grader-blade assembly. An embodiment facilitates adjustment of the retainer assembly, as in the case of wear, without the necessity of hand tools.

20 Claims, 6 Drawing Sheets

WRENCHLESS ADJUSTABLE/COMPLIANT MOLDBOARD INSERT

BACKGROUND OF THE INVENTION

The present invention provides an adjustable grader-blade retainer assembly that affords blade movement side-to-side.

SUMMARY OF THE INVENTION

The instant grader-blade retainer assembly incorporates a compliant attachment of the retainer assembly to the grader blade assembly.

Additional embodiments of the invention include a storable and lockable handle for implementing adjustment of the retainer assembly without the need for hand tools.

DESCRIPTION OF INVENTION

Motor graders are provided with scraping blades for the displacement, distribution and leveling of material, typically soil. Effective use of a motor grader involves shifting the blade thereof from side-to-side. To permit side-to-side blade movement, grader blades are attached to a frame including guide rails. As noted among prior art including U.S. Pat. Nos. 4,683,959; 5,076,370; 5,687,800 and 6,585,059 all incorporated herein by reference, the guide rails are necessarily position in close proximity to the soil. As a result, soil contact with the guide rails coupled with movement of the blade assembly over the rails causes erosion of the rails and the wear points of the blade retainer assembly.

Figure 2:
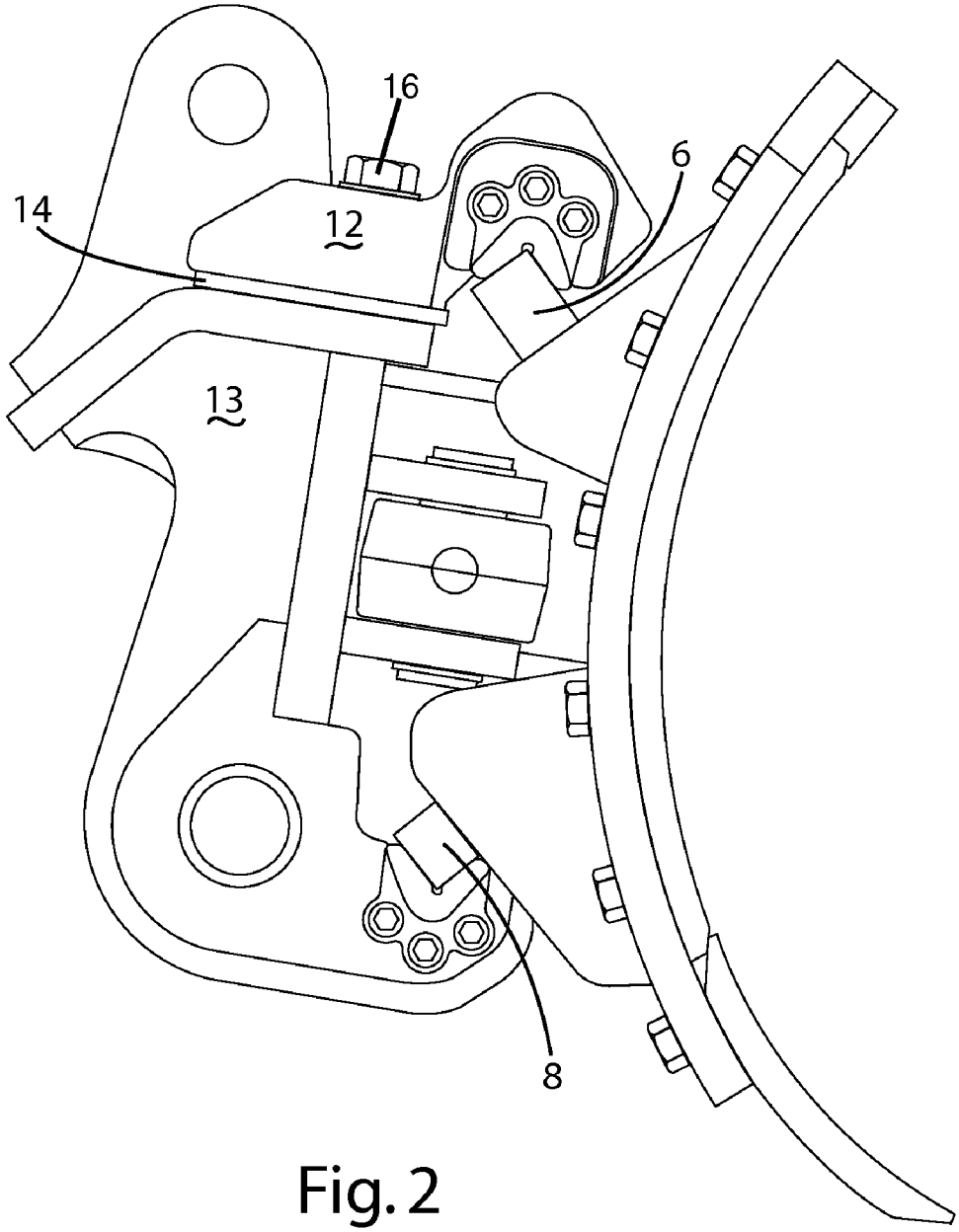
Fig. 2 Prior Art
FIG. 2 illustrates a typical known grader-blade retainer assembly.

Close engagement of the blade retainer with the guide rails maintains the position of the blade as the blade encounters resistance, such as stones, rock, or varying amounts of soil as the grader effects displacement of the soil. Customary adjustment of grader-blade retainer assemblies as illustrated by FIG. 2 is effected by the installation of shims 14 between attachment points of the blade retainer 12 and the attachment points of the blade retainer on the blade carrier frame 13. While effective, adjustment by shim installation requires advance planning including, having available: appropriate shims, necessary hand tools, an interruption of scheduled work, sufficient time to disassemble the blade retainer, sufficient down time of the grader to complete the repair, and time to evaluate the adjustment and re-do the repair if the selected shims result in an assembly the is too tight to efficiently slide from side-to-side or too loose to effectively control the grader blade.

The erosion/wear of blade guide rails is not necessarily uniform along their length. If wear/erosion of the guide rails is more extensive near a centered position of the blade, then adjustment of the blade retainer with shims properly adjusted for the center of the guide rails may result in a too tight fit as the blade is shifted to either side. Alternatively if the shims are adjusted for the outside edge, the retainer may be loose when the blade is located in a near center position.

In one aspect, the instant invention affords a compliant blade retainer adjustment affording close engagement of blade retainer with blade guide rails and compliance for unevenly worn guide rails.

In another aspect, the instant invention affords adjustment of blade retainers without hand tools, shims, or the necessity of disassembly of the blade retainer.

These and other advantages of the invention will be apparent from the following description and claims.

Figure 1:
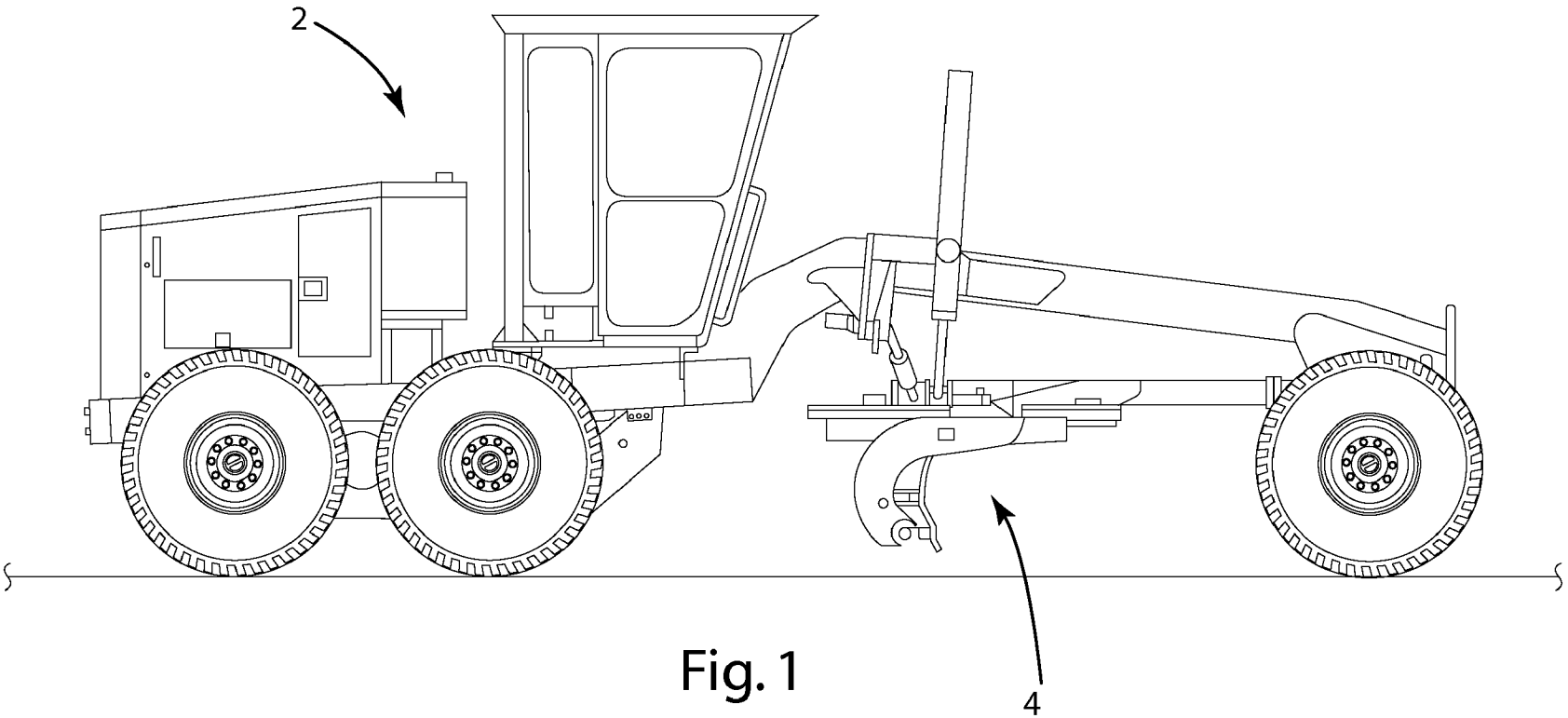
Fig. 1 Prior Art
FIG. 1 shows a typical motor grader.

In FIG. 1 is shown a typical motor grader 2 having a moldboard assembly 4 including guide rails 6, 8. As illustrated in FIG. 2, the guide rails 6, 8 are oriented in a near vertical plane. While such orientation is operable, the orientation may deviate from near vertical so long as the guide rails the function of resisting upward thrust from the soil and materials found therein, and rearward thrust from resistance of soil being pushed by the grader. Blade pitch may be described as movement of the top edge of the blade generally along the vehicle axis forward and rearward with respect to the lower blade edge so as to change the angle at which the blade intersects level ground. Often blades are contoured in a concave shape as viewed from the front of the vehicle. The blade-ground angle of intersection in the case of curved blades in such instance would relate to the angle created by the intersection of a tangent to the curve of the blade with level ground. A change of blade pitch alters the orientation of the guide rails.

As illustrated, the rails are shown has having a square cross-section. Triangular, diamond, rectangular, circular and other polygon shaped cross-sections may also be employed as guide rails.

FIG. 2 shows a guide rail 6 and blade retainer 12 of the prior art assembled thereon incorporating the shim-style retainer adjustment. Shims 14 and fastened below the retainer assembly 12 and above the blade carrier frame 13 adjust for wear of the wear insert and guide rails. The retainer and shims are fastened to the blade carrier by cap screws 16.

Figure 3:
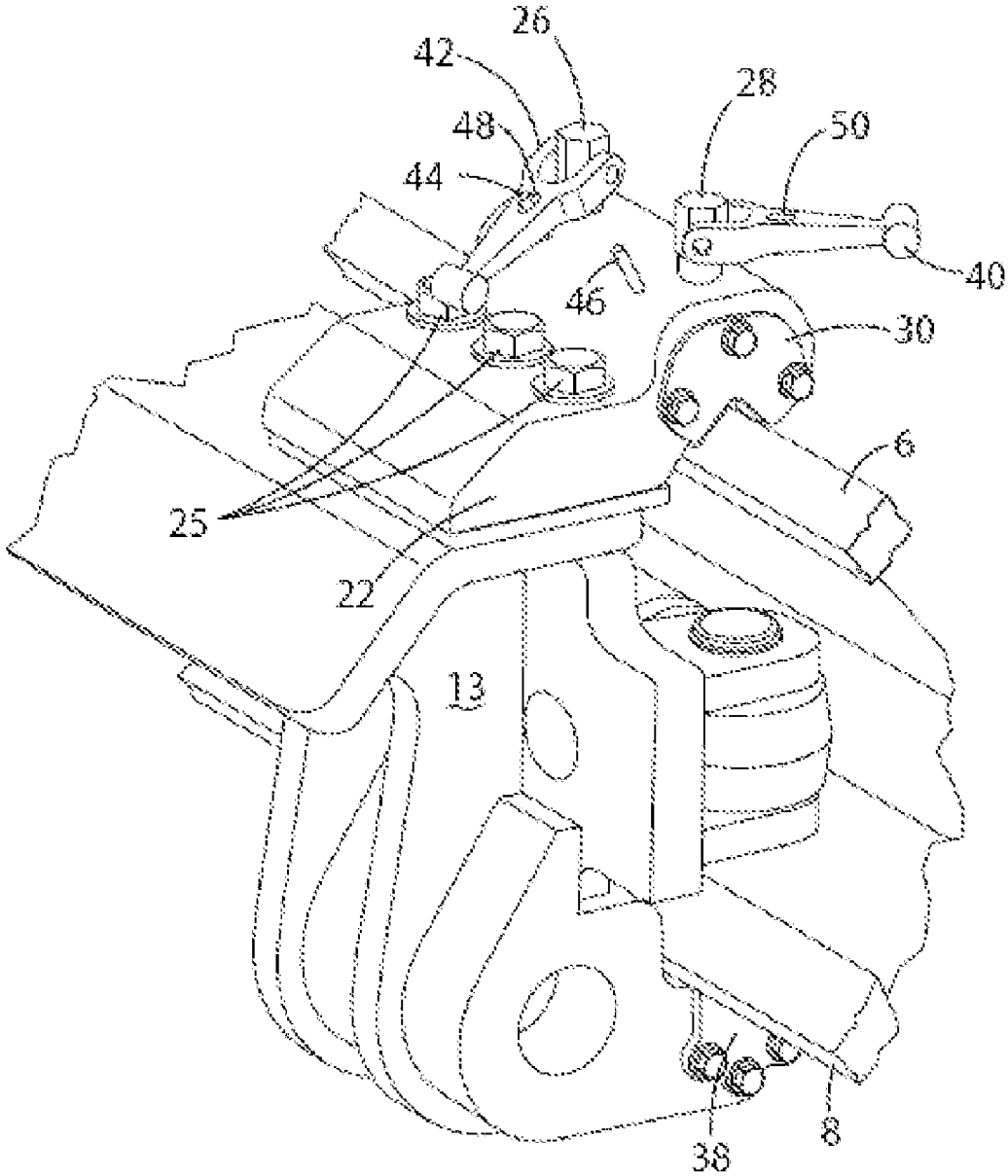
FIG. 3 illustrates an embodiment of the instant compliant grader-blade retainer assembly as assembled on a grader.

Turning to FIG. 3, an Oblique view of the compliant retainer assembly 22 of the instant invention shows the assembly fastened to the blade carrier frame 24 by retainer cap screws 25. The retainer assembly incorporates adjustment for by means of threaded adjusters 26, 28. A cover 30 in combination with the blade retainer 12 and guide rail 6 serves to preserve the position of wear insert 32 and optionally may retain a resilient wiper to clean the guide rails of dirt and debris as the rails slide through the retainer assembly.

Figure 4:
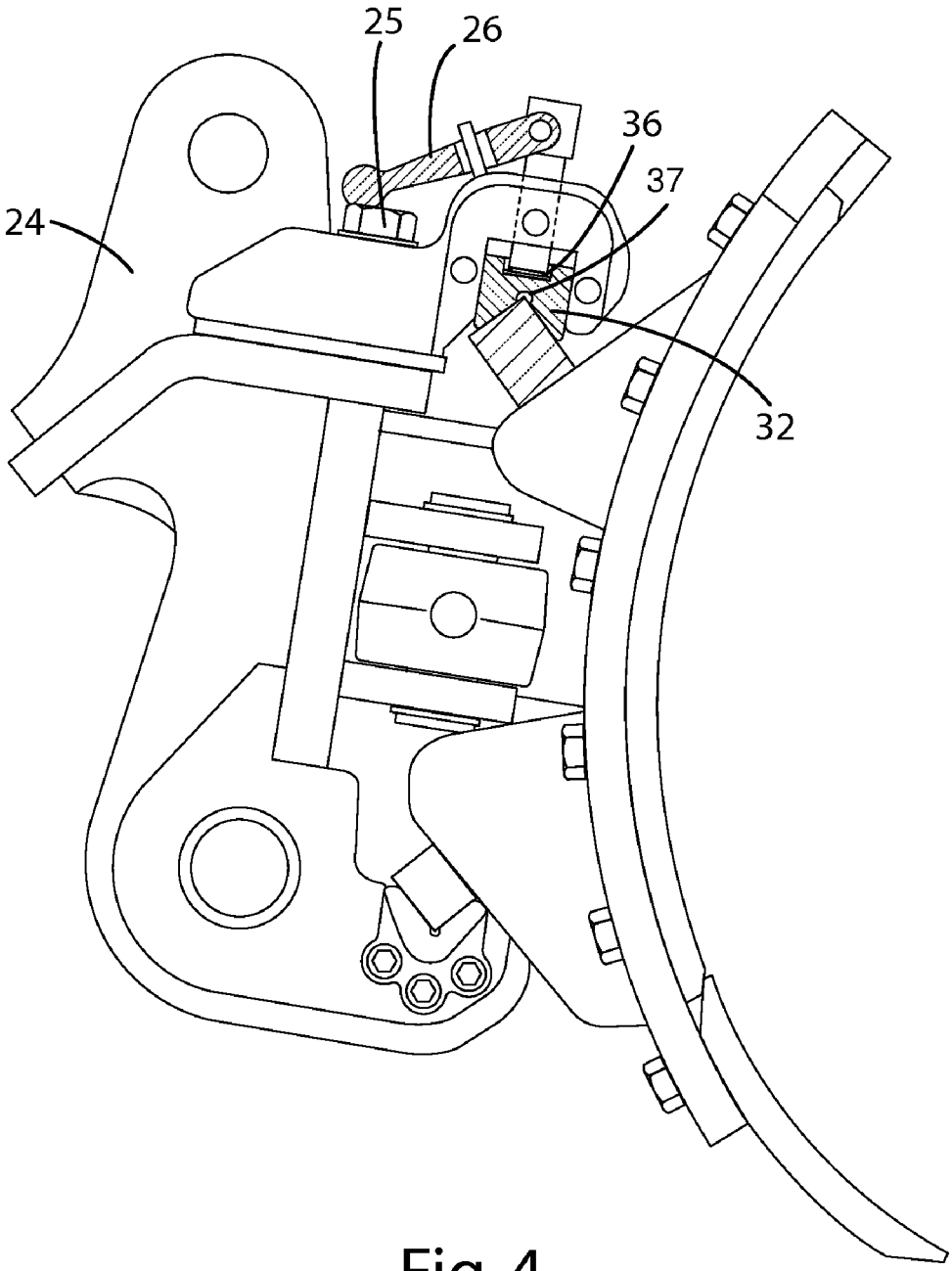
FIG. 4 illustrates an embodiment of a compliant grader-blade retainer assembly in cross-section.

In a cross-section view of a compliant retainer assembly 22 provided by FIG. 4, there can be seen a compliant member 36. Advantageously such compliant member may be a cupped spring washer, also known by the name 'Belleville washer'. Wear insert 32 is shown as a one-piece having a "V" shape having fillet 37. In other embodiments, the function of the wear insert may be met by two or more separate inserts retained within the compliant retainer assembly.

The V-shape of the wear insert 32 of the illustrated embodiment, and the mating surface of the guide rails 6, 8 affords an adjustment in both the vertical and horizontal direction by a single adjustment of the threaded adjusters 26, 28. Threads, not shown, matching those of the threaded adjusters are provided in the compliant retainer assembly 22. Wear inserts 32 are fitted in the space therefore in the compliant retainer assembly 22. Cover 30 attached to the compliant retainer assembly 22 prevents displacement of the wear inserts along the guide rails from their position in the retainer assembly. FIG. 4 is shown with cover 30 removed.

In addition to the compliant retainer assembly, the blade carrier frame 24 is also provided with a non-compliant retainer assembly 38. As shown, the compliant blade retainer assembly is positioned above the non-compliant blade retainer assembly. In the illustrated configuration the properly adjusted compliant member affords resilience sufficient to maintain the wear insert in contact with the guide rails. An inverse configuration would require resilience sufficient to support the weight of the blade carrier frame, and the moldboard and blade attached thereto, in addition to providing resilience to maintain contact with the wear insert of the non-compliant retainer now in the upper position.

FIG. 3 displays an embodiment of the invention that facilitates tool less adjustment of the compliant blade retainer having a handle 40, 42 attached to the threaded adjusters, 26, 28. As a permanently attached appurtenance to the threaded adjusters, the handles are available whenever adjustment of the resilience between the compliant retainer assembly 22 and the guide rails 6, 8 is called for. In the disclosed embodiment cranks 40, 42 may be locked to the compliant retainer assembly by pins 44, 46 by apertures 48, 50 in handles 40, 42. Further, cotter pins, such as the well known hairpin variety are useful to prevent the cranks from separating from the pins 44, 46 during use. The cotter pins may be positioned through a bore in pins 44, 46, or positioned in a groove in pins 44, 46 or other means that enables tool less access to handles 40, 42.

A further advantageous feature provided by the adjusted compliant blade retainer that the wear insert itself also serves to remove soil from the guide rails thereby reducing soil induced wear of the wear inserts and guide rails. A blade retainer system adjusted by shims according to the prior art necessarily is adjusted to accommodate the widest separation of the wear surfaces of guide rails. Such adjustment may permit vertical and horizontal free play of the blade where the guide rails particularly as the guide rails/wear inserts become worn from use.

The location where the guide rails experience greatest wear would generally correspond to the position of the blade nearly centered under the grader vehicle, as this is the blade position used most often. When the grader blade is adjusted by non-compliant blade retainers for the position were rail wear and erosion are minimized, then the blade is subsequently positioned to the location where the wear and erosion of the guide rails is at a maximum, then the blade may not be adequately retained by the blade retainer. At the location of maximum wear, the difference between the maximum and minimum separation of the wear surfaces of the guide rails corresponds to unrestrained movement of the blade retainer on the guide rails and unrestrained (except by the weight of the blade and associated apparatus) movement of the blade. This maximum opening between the wear insert and the guide rails, enables entry of contaminants into the space between the wear insert and the guide rails. As this location is as defined a location of where the guide rails are worn, the access by contaminants serves to accelerate the wear of the guide rails at an already worn location.

By maintaining constant contact with the wear surfaces of the guide rails whether at maximum or minimum separation, the disclosed compliant retainer assembly removes unrestrained movement of the grader blade in either a horizontal or vertical direction, and serves to keep contaminants from between the wear surface of the guide rails and the wear inserts.

Impact of a grader blade with a highly resistive surface, such as a dense compact soil, rocks, or concrete in the soil will tend to force the blade vertically upward and horizontally opposite to the (forward or rearward) direction of travel of the grader. Deflection of the disclosed compliant member, Belleville washers, is on the order of 3 mm or less. Thus, where compliance of the retainer assembly is afforded by one Belleville washer, the deviation at the blade retainers is on the order of 3 mm, or less. It is apparent therefore that the deviation from vertical and horizontal resistance at the blade extremities is likewise small and tolerable.

Other compliant members could be formed from a resilient polymer such as natural or synthetic rubber. Advantageously, the compliance of such rubber member would be limited by constraining the rubber member in a defined volume adjustable as described herein.

Figure 5:
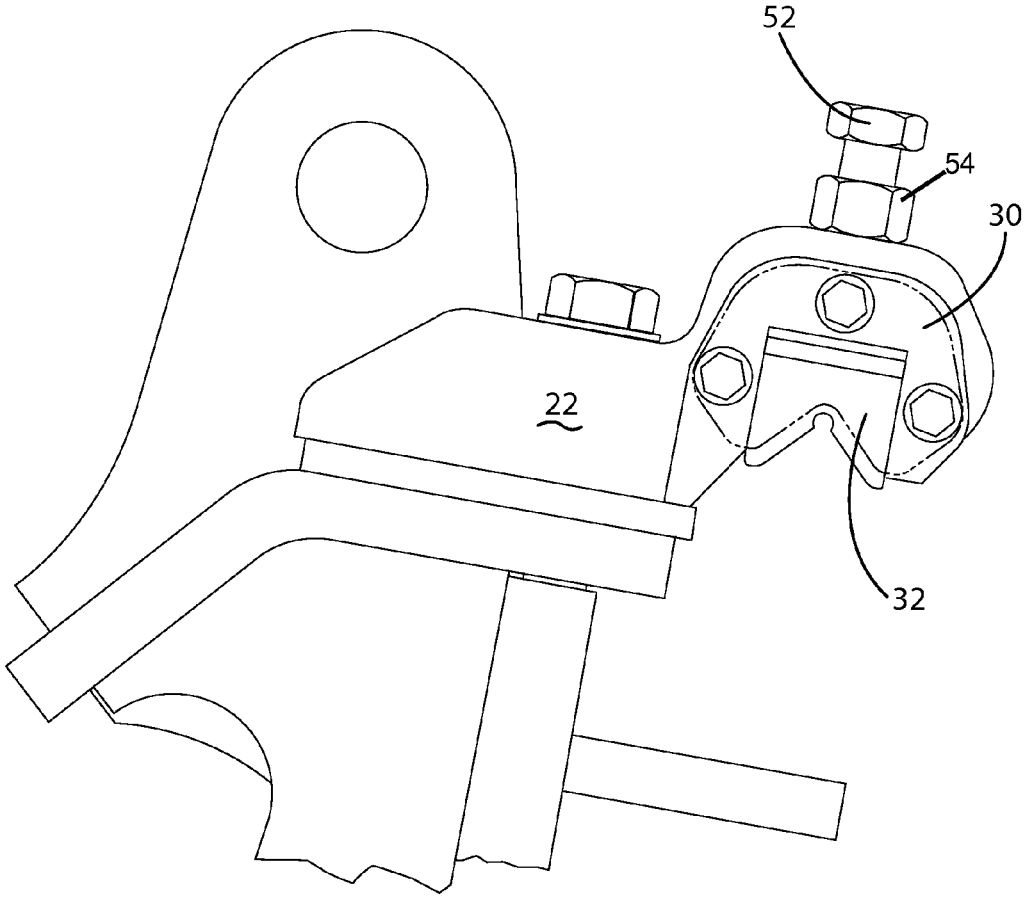
FIG. 5 illustrates an alternative embodiment of a compliant grader-blade retainer assembly.

An alternative embodiment that affords a compliance without the tool free adjustment feature is disclosed FIG. 5. Cap screws, 52 and lock nuts 54 are used to adjust the compliant blade retainer.

Figure 6:
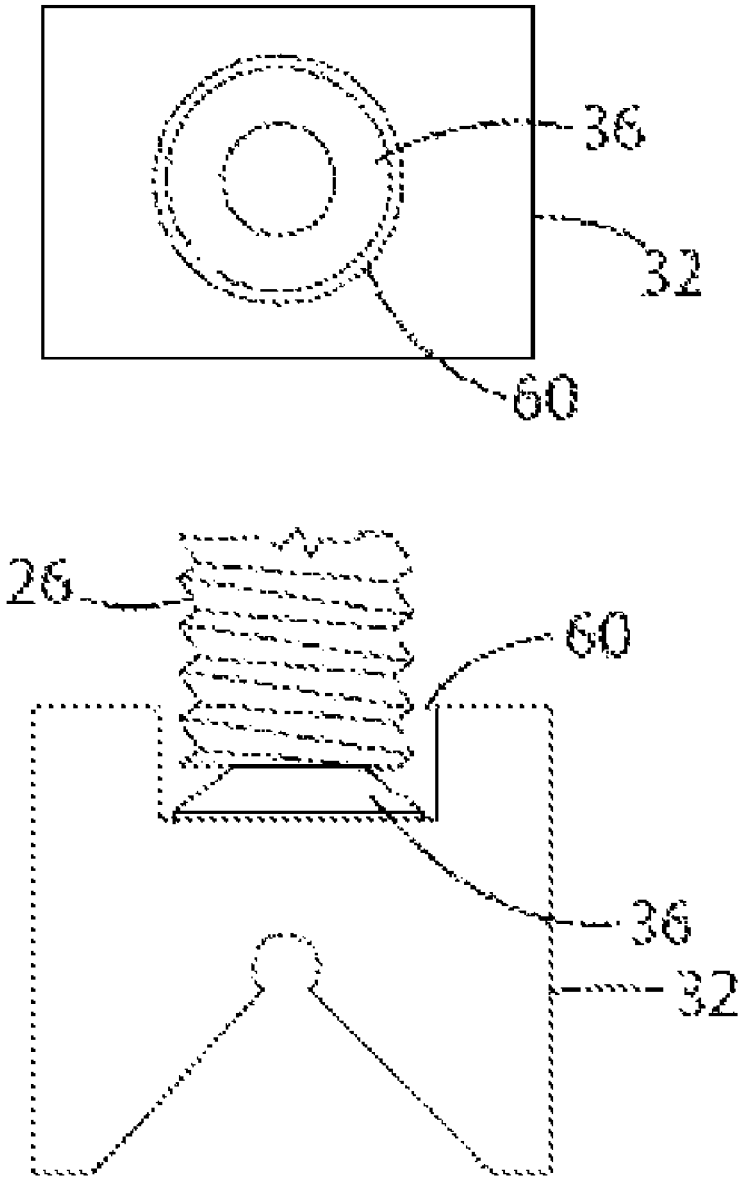
FIG. 6 illustrates an embodiment of a wear insert 32 threaded adjuster 26, 28 and a compliant member 36.

Illustrated at FIG. 6 is an embodiment of the wear insert 32 having a bore 60 therein for receiving the compliant member 36 and threaded adjuster 26, 28.

What is claimed is:

1. A grader blade assembly for use with a motor grader, the grader blade assembly comprising:
- a blade carrier frame,
- a grader blade supported by the blade carrier frame,
- upper and lower rails affixed, directly or indirectly, to the grader blade,
- an upper retainer assembly positioned between the blade carrier frame and the upper rail, the upper retainer assembly including:
  - an upper retainer assembly frame,
  - one or more wear inserts slideably engaged with said upper rail,
  - at least one adjustor engaged with the upper retainer assembly frame, wherein the at least one adjustor provides adjustment of the position of the one or more wear inserts relative to the upper retainer assembly frame, and
  - one or more compliant members positioned between the at least one adjustor and the one or more wear inserts, the one or more compliant members urging the one or more wear inserts toward the upper rail.

2. The grader blade assembly of claim 1, wherein the at least one adjustor includes at least one threaded adjustment screw.

3. The grader blade assembly of claim 2, wherein said at least one adjustment screw also comprises a moveable handle for turning said at least one adjustment screw.

4. The grader blade assembly of claim 3, wherein said moveable handle is lockable in the time interval between adjustments.

5. The grader blade assembly of claim 2 wherein the at least one threaded adjustment screw are cap screws, and the adjustment of the cap screws is preserved by means of at least one nut tightened on each of the cap screw threads to prevent unintentional rotation of the cap screws.

6. The grader blade assembly of claim 1 wherein the one or more compliant members includes one or more cupped spring washers.

7. The grader blade assembly of claim 1 wherein the one or more compliant members includes one or more rubber members.

8. The grader blade assembly of claim 7 wherein the upper retainer assembly frame defines a space, wherein the one or more rubber members is constrained within the space.

9. A grader blade assembly for use with a motor grader including:

a blade carrier frame, a grader blade supported by the blade carrier frame, the grader blade defining a horizontal midpoint, at least one upper guide rail coupled to the grader blade, the at least one upper guide rail being positioned above the horizontal midpoint, an upper retainer assembly coupled to the blade carrier frame, the upper retainer assembly configured to align with the at least one upper guide rail, the upper retainer assembly including:

a frame member, a wear insert coupled to the frame member of the upper retainer assembly, a compliant member operably coupled to the frame member, the compliant member configured to urge the wear insert against the at least one upper guide rail, and an adjustor positioned adjacent to the compliant member, the adjustor providing adjustment of the amount of urging of the compliant member.

10. The grader blade assembly of claim 9, further comprising a lower noncompliant retainer assembly fastened to the blade carrier frame, the lower noncompliant retainer assembly operably coupled to at least one lower guide rail.

11. The grader blade assembly of claim 9, wherein the adjustor includes a crank for threaded adjustment.

12. The grader blade assembly of claim 11, wherein the crank defines a crank aperture, wherein the frame member includes a frame pin, wherein the crank aperture is configured to accept the frame pin.

13. The grader blade assembly of claim 12 wherein the frame pin defines a void selected from the group consisting of a frame pin bore and a frame pin groove.

14. The grader blade assembly of claim 13 further comprising at least one cotter pin positioned within the void, wherein the frame pin is positioned within the crank aperture in order to lock the crank to the upper compliant retainer assembly.

15. A grader blade assembly for use with a motor grader, the grader blade assembly comprising:

a blade carrier frame, a grader blade supported by the blade carrier frame, at least one upper rail affixed, directly or indirectly, to the grader blade, at least one lower rail affixed, directly or indirectly, to the grader blade, at least one upper retainer assembly positioned between the blade carrier frame and the at least one upper rail, the at least one upper retainer assembly including:

at least one retainer assembly frame, one or more wear inserts slideably engaged with the at least one upper rail, one or more compliant members positioned between the at least one retainer assembly frame and the one or more wear inserts, the one or more compliant members urging the one or more wear inserts toward the upper rail, and at least one adjustor engaged with the at least one retainer assembly frame, the at least one adjustor providing adjustment of the amount of force placed against the at least one upper rail by the one or more wear inserts.

16. The grader blade assembly of claim 15, further comprising a cover attached to the at least one retainer assembly frame, the cover engaged with the at least one guide rail.

17. The grader blade assembly of claim 16, further comprising a shim positioned between the at least one upper retainer assembly and the blade carrier frame.

18. The grader blade assembly of claim 17, wherein the cover is urged toward the at least one upper rail by the shim.

19. The grader blade assembly of claim 16, wherein the cover includes a resilient wiper urged toward the at least one upper rail by the shim.

20. The grader blade assembly of claim 15, wherein the one or more compliant members are configured to absorb impact forced on the grader blade.

* * * * *